US009579250B2

(12) United States Patent
Nichols

(10) Patent No.: US 9,579,250 B2
(45) Date of Patent: Feb. 28, 2017

(54) HANDHELD MOTORIZED FACIAL BRUSH HAVING PIVOTING, FLOATING HEAD

(76) Inventor: Thomas Nichols, Laguna Niguel, CA (US)

( * ) Notice: Subject to any disclaimer, the term of this patent is extended or adjusted under 35 U.S.C. 154(b) by 1045 days.

(21) Appl. No.: 13/603,081

(22) Filed: Sep. 4, 2012

(65) Prior Publication Data

US 2013/0060176 A1 Mar. 7, 2013

Related U.S. Application Data

(63) Continuation-in-part of application No. 13/173,439, filed on Jun. 30, 2011, now Pat. No. 9,272,141, and a continuation-in-part of application No. 13/592,226, filed on Aug. 22, 2012.

(51) Int. Cl.

| | |
|---|---|
| ***A61H 7/00*** | (2006.01) |
| ***A46B 13/02*** | (2006.01) |
| ***A61H 23/02*** | (2006.01) |
| ***A46B 13/00*** | (2006.01) |

(52) U.S. Cl.

CPC ..... *A61H 7/005* (2013.01); *A46B 13/008* (2013.01); *A46B 13/023* (2013.01); *A61H 23/02* (2013.01); *A46B 2200/102* (2013.01); *A61H 2201/10* (2013.01); *A61H 2201/14* (2013.01); *A61H 2201/1685* (2013.01); *A61H 2205/022* (2013.01)

(58) Field of Classification Search

CPC ..... A61H 2201/14; A61H 2201/1685; A61H 7/002; A61H 7/005; A61H 2201/10; A46B 13/023; A46B 13/008

See application file for complete search history.

(56) References Cited

U.S. PATENT DOCUMENTS

| | | | | |
|---|---|---|---|---|
| 5,007,168 | A | 4/1991 | Messinger et al. | |
| 5,423,102 | A | 6/1995 | Madison | |
| 5,577,324 | A | 11/1996 | Tanaka | |
| 5,891,063 | A | 4/1999 | Vigil | |
| 5,950,268 | A * | 9/1999 | Murphy | A46B 13/02 15/28 |
| 6,170,108 | B1 * | 1/2001 | Knight | A46B 13/008 15/29 |
| D549,964 | S | 9/2007 | Roth et al. | |
| 7,306,569 | B2 * | 12/2007 | LaJoie | A45D 33/005 601/17 |

(Continued)

*Primary Examiner* — Justine Yu
*Assistant Examiner* — Timothy Stanis
(74) *Attorney, Agent, or Firm* — Steins & Associates, P.C.

(57) ABSTRACT

The heads interface with a conventional handpiece so that the facial brush or other facial treatment head can be removed and replaced with a subassembly that provides pivoting/floating support. The treatment head is then attachable to the pivoting/floating subassembly as if it were attaching to the handpiece; the result being a motorized skin treatment head that pivots and/or floats to follow the contour of the skin. The internal motor can either be housed within the handpiece, or pivoting/floating subassembly, and will either provide rotation/oscillation of the treatment head, or simple vibrations to the handpiece and/or treatment head. The floating mechanism may be available in a variety of forms to provide the widest variety of use scenarios. Each floating mechanisms and/or subassemblies are interchangeable with the others so as to be removably attachable to the handpieces described in the Parent applications.

10 Claims, 19 Drawing Sheets

(56) References Cited

U.S. PATENT DOCUMENTS

| | | | | |
|---|---|---|---|---|
| 7,320,691 | B2 | 1/2008 | Pilcher et al. | |
| 7,370,420 | B2 | 5/2008 | Shimizu | |
| 7,386,906 | B2 | 6/2008 | Roth et al. | |
| D612,612 | S | 3/2010 | Harris et al. | |
| 7,707,674 | B2 | 5/2010 | Schonewille et al. | |
| 7,743,508 | B2 | 6/2010 | Shimizu, III | |
| 7,789,092 | B2 | 9/2010 | Akridge et al. | |
| 7,810,201 | B2 | 10/2010 | Braun | |
| 7,937,792 | B2 | 5/2011 | Munn et al. | |
| 2002/0157257 | A1 | 10/2002 | Oswald | |
| 2005/0066996 | A1 | 3/2005 | France et al. | |
| 2005/0199265 | A1 | 9/2005 | France et al. | |
| 2006/0168746 | A1 | 8/2006 | Guyuron et al. | |
| 2007/0124936 | A1 | 6/2007 | Okabe | |
| 2009/0217471 | A1* | 9/2009 | Weinberger ..... | A46B 7/04 15/111 |
| 2010/0275446 | A1 | 11/2010 | Schmitt et al. | |
| 2011/0030220 | A1 | 2/2011 | Shimizu, III | |
| 2011/0138563 | A1 | 6/2011 | Phgura | |

* cited by examiner

HANDHELD MOTORIZED FACIAL BRUSH HAVING PIVOTING, FLOATING HEAD

The present invention is a Continuation-in-part of U.S. application Ser. No. 13/173,439 now U.S. Pat. No. 9,272,141, filed Jun. 30, 2011 and Ser. No. 13/592,226, filed Aug. 22, 2012 (and any related Provisional Patent Applications), both now pending (hereinafter "the parent applications").

BACKGROUND OF THE INVENTION

1. Field of the Invention

This invention relates generally to facial skin care appliances and, more specifically, to a Handheld Motorized Facial Brush Having Pivoting, Floating Head.

2. Description of Related Art

Facial massage and skin treatment devices are widely known in the art. One particular functional feature that has not been widely implemented is the device having a face-hugging or "floating" treatment head. The advantage of a floating head is that the face of the treatment head will tend to remain in contact with the user's skin while traversing the irregular topography that tends to define a person's face in particular.

Specific examples of devices in this field are listed herein.

Facial/Skin Treatment Devices:

Vigil, U.S. Pat. No. 5,891,063 is a "Skin Rejuvinating System" that includes a rotating bi-level brush. No floating capability. Harris, U.S. Pat. No. D612,612 discloses a design that appears to be a rotating and somewhat pivoting treatment brush. Roth, U.S. Pat. No. D549,964 shows the shape of a motorized facial brush without suggesting any pivoting motion. Akridge, U.S. Pat. No. 7,789,092 and Roth, U.S. Pat. No. 7,386,906 are related to the Roth design patent reference, but fail to suggest any pivoting motion or the light/vibration/microcurrent emissions. Pilcher, U.S. Pat. No. 7,320,691 discloses an "Apparatus and Method for Acoustic/Mechanical Treatment of Early Stage Acne"—while this reference does relate to the field of the instant invention, but it does not disclose any pivoting or floating head design.

Utility Cleaning Devices:

Murphy, U.S. Pat. No. 5,950,268 is a "Hand-held Scrubbing Device" for a utility scrubber (such as for bathroom walls) that couples a rotating brush head with a pivoting motion. Murphy fails to suggest internal vibration, LED lighting, microcurrent. Furthermore, the Murphy pivoting head assembly is comprised of a complex pivot ball joint design that seems quite costly to implement.

Madison, U.S. Pat. No. 5,423,102 for a "Portable Cleaning Device" that implements a rotating/reciprocating cleaning head (brushes and other implements), that uses a textured pivot ball to transfer torque from the drive motor to the cleaning head. Like Murphy, Madison fails fails to suggest internal vibration, LED lighting or microcurrent emissions.

Guyuron, U.S. Patent Application Publication No. 20060168746 for a "Personal Cleaning Device" has a flexible cleaning head that can rotate or oscillate. It further discloses a plurality of different brush, sponge and abrasive pad cleaning heads and covers. Munn, U.S. Pat. No. 7,937,792 is a "Pole Scrubber" that has an external pivoting cam—not suitable for floating design or for facial skin care. Schonewille, U.S. Pat. No. 7,707,674, discloses a wide variety of handheld cleaning devices having motorized brush heads, but none of these devices has a flexible brush substrate or other pivoting mechanisms suitable for a hygienic facial massage/scrubbing device. France, U.S. Patent Application Publication Nos. 20050066996 and 20050199265 disclose a stain removal brush, but with a head that only tilts and does not "float" or "pivot."

Toothbrushes:

Phgura, U.S. Patent Application Publication No. 20110138563 is a motorized toothbrush having at least one embodiment with a ball-joint pivoting/rotating head.

Electric Shavers

Oswald, U.S. Patent Application Publication No. 20020157257 does disclose a shaver having a pivoting head having flexible screens, but the structure of that pivoting design only permits pivoting along a single axis (rather than in all axes passing through the head). Schmitt, U.S. Patent Application Publication No. 20100275446, discloses a set of three pivoting heads. The Schmitt heads do pivot around rotating drive shafts, but the re-centering (i.e. the force urging the heads to be coplanar with the shaver face) is created by a somewhat complex, spring-loaded design that is not suitable for the moist environment in which facial skin care devices are generally used. Tanaka, U.S. Pat. No. 5,577,324 discloses a three-bladed shaver that flexes on a group of "cushion elements" that appear to be soft mounting connections between the blades and the shaver housing. The cushioning elements are not directly interconnected to the shaver head, nor are they rotatable. Messinger, U.S. Pat. No. 5,007,168 describes a complex system that has the motor and shaver head pivot along a single axis.

Shimizu, U.S. Patent Application Publication No. 20110030220 and U.S. Pat. Nos. 7,743,508 and 7,370,420 is a rotary shaver that does have an internal pivot ball, but does not include a pliable support cup for restoring the head to its rest position. Okabe, like the Shimizu references, has pivot balls but no pliable support cup.

Careful review of these prior devices reveals that the following references fails to suggest and internal vibrating mechanism to provide massaging force without the requirement for the head to oscillate or rotate. Furthermore, none of these prior devices has a floating head mechanism that is suitable for the moist, hygienic environment of facial skin care.

SUMMARY OF THE INVENTION

In light of the aforementioned problems associated with the prior devices, it is an object of the present invention to provide a Handheld Motorized Facial Brush Having Pivoting, Floating Head. The heads should interface with a conventional handpiece so that the facial brush or other facial treatment head can be removed and replaced with a subassembly that provides pivoting/floating support. The treatment head should then be attachable to the pivoting/floating subassembly as if it were attaching to the handpiece, with the result being a motorized skin treatment head that pivots and/or floats to follow the contour of the skin. The internal motor should either be housed within the handpiece, or within the pivoting/floating subassembly, and should either provide rotation/oscillation of the treatment head, or simple vibrations to the handpiece and/or the treatment head. The floating mechanism should be available in a variety of different forms so that the widest variety of use scenarios can be accomplished. Each of these floating mechanisms and/or subassemblies should be interchangeable with the others and be removably attachable to the handpieces described in the Parent applications.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Handheld Motorized Facial Brush Having Pivoting, Floating Head.

Figure 1:
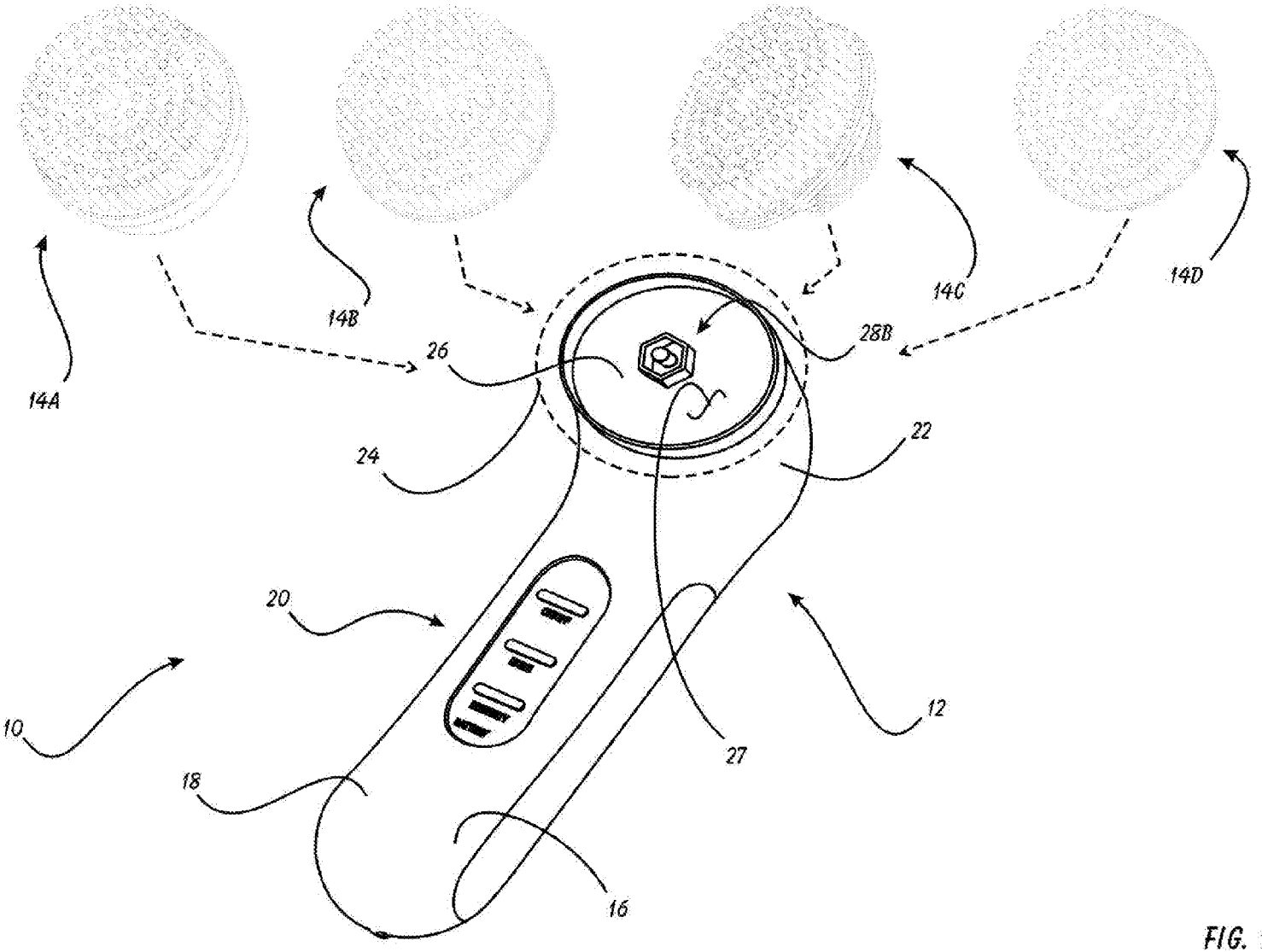
FIG. 1 is a perspective view of a preferred embodiment of the motorized handheld facial brush having a floating head of the present invention, along with a plurality of preferred floating head embodiments.

The present invention can best be understood by initial consideration of FIG. 1. FIG. 1 is a perspective view of a preferred embodiment of the motorized handheld facial brush having a floating head 10 of the present invention, along with a plurality of preferred floating head embodiments. As will be discussed in additional detail hereinbelow, the essential aspects of the preferred designs as depicted and discussed herein are:

i. the motorized handpiece 12 may be configured to operate in a variety of modes, including rotation of the drive assembly, rotary oscillation of the drive assembly, and/or only vibration of the handpiece due to operation of an internal mechanism, such as is disclosed in prior patent application Ser. No. 13/173,439, filed Jun. 30, 2011;

ii. each disclosed floating head 14, and those not specifically disclosed herein, provide "floating" motion so that the treatment surface of the head 14 seeks to follow the contour of the user's skin while the head is rotating/oscillating/vibrating—it has been determined that up to sixteen (16) degrees of deflection from the rest position is desirable; and iii. while the depicted disclosures are limited to brush bristles herein, it should be understood that a variety of treatment heads/surfaces are expected, including sponge, LED light-emitting, micro-current emitting, and others. Those shown here are merely exemplary.

The handpiece 12 comprises a housing 16 defined by a handle portion 18 that is suited to be comfortably grasped by the typical user's hand, and a head portion 22 at its opposing end. The housing 16 is further defined by a control panel 20 to provide the user with conveniently-located touch-sensitive switches to turn on and off the various modes available from the device 10.

An electric motor and power supply (not shown) are mounted within the interior of the housing 16. The power supply is preferably an internal rechargeable battery having optional capability for auxiliary external plug-in to a wall socket. Whether or not the internal batteries are rechargeable, they may also be replaceable. The motor may generate a rotational, oscillating and/or internal vibrations, such as that described in the two parent applications.

The head portion 22 terminates in a generally circular face portion 24 that includes a face wall 26 (which is generally planar and bounded by a ridge), and a drive assembly (e.g. 28B). The drive assembly (e.g. 28B) could take a variety of forms, and may be movable relative to the face wall 26 (for rotating/oscillating versions) or may be fixed so that there is no relative movement therebetween (for vibrating version). Also, the hexagonal profile shown is only a single type.

The face wall 24, as discussed above, is generally planar in form. The wall 24 defines a first spatial plane 27. This plane 27 is used herein in order to characterize the "floating" motion exhibited by the various floating heads (generically 14). Simply put, in addition to any rotating/oscillating/vibrating motion, the heads 14 are able to tilt or pivot so that the face of the head follows the contour of the user's skin as the user places the head 14 against their skin and translates across the treatment area.

Four distinct head 14 designs are disclosed herein. The first floating head 14A employs a pivot head and pliable support cup to provide flexing support for the treatment face so that the treatment face can float, as desired. The element interconnecting the treatment face of the second floating head 14B and the drive assembly (e.g. 28B) has a material composition and cross-section to permit the treatment head to float. The third floating head 14C incorporates a spring-loaded "joystick" type design to create the desired floating action. Finally (for the limited disclosure herein), the fourth floating head has a cage of longitudinal spring elements creating the desired floating motion. The first of these designs is specifically discussed below in connection with FIGS. 2 through 5.

Figure 2:
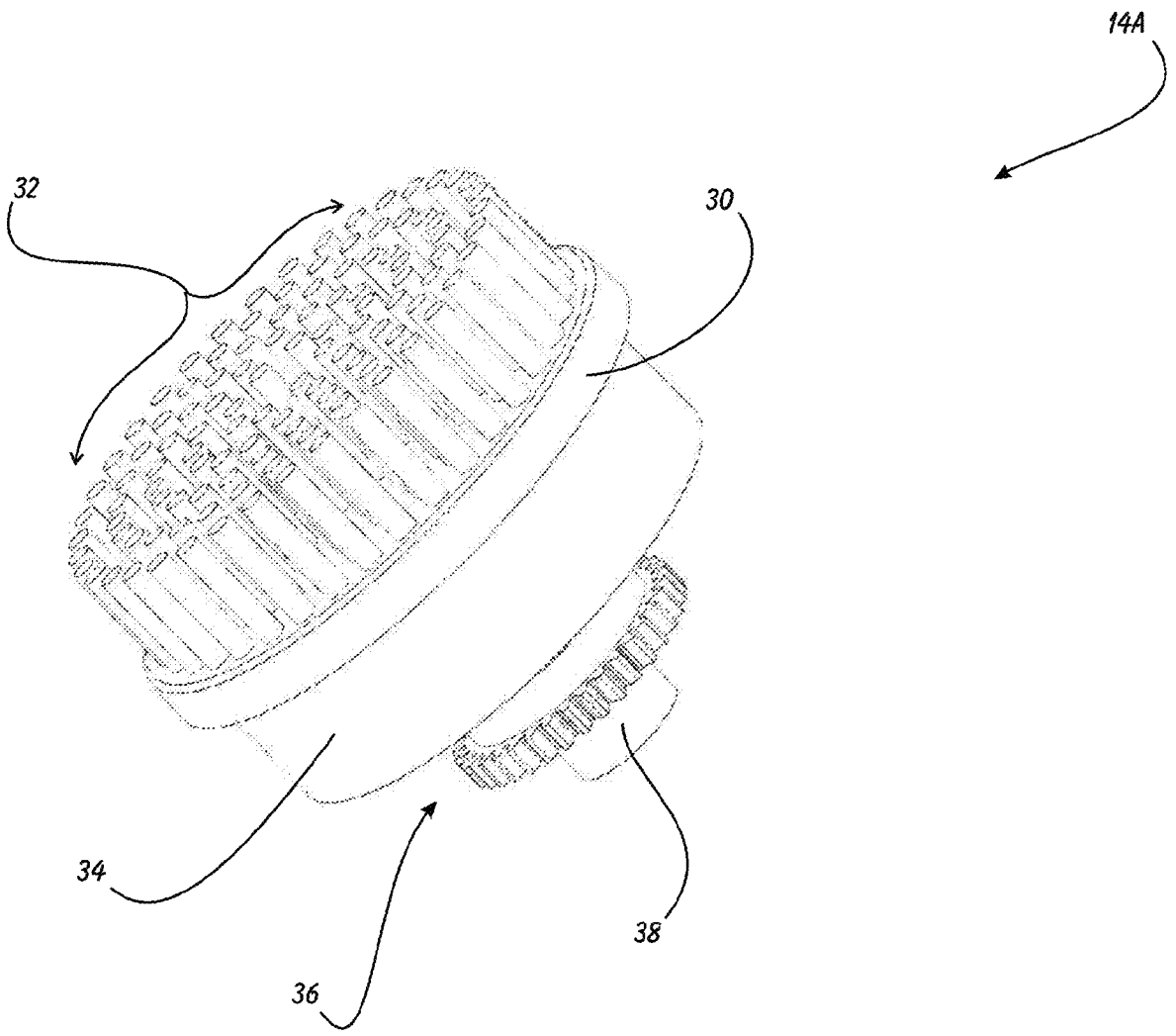
FIG. 2 is a perspective view of the first floating head of FIG. 1.

FIG. 2 is a perspective view of the first floating head 14A of FIG. 1. The first floating head 14A is defined by a substrate element 30. While the substrate 30 shown here is flat and circular, it is understood that a wide variety of shapes for the substrate 30 could be used, including but not limited to triangular, square, ovoid. Further, cupped or dome-shaped profiles might be desired and are feasible for this head 14A, as well as those other head designs discussed herein below.

The floating head 14A has a plurality of brush elements 32 (or sponge material or other treatment surface as discussed above) extending from an upper or first side. The perimeter of the substrate 30 on its bottom or second side is supported by support cup 34. The support cup 34 is made from a pliable, rubber-like material that will allow for some flexing in the cup 34 to allow the substrate 30 to "float." One particular material that is deemed suitable for this application is a plastic having a material property of a 50 to 60 durometer scale (hardness) reading.

Figure 3:
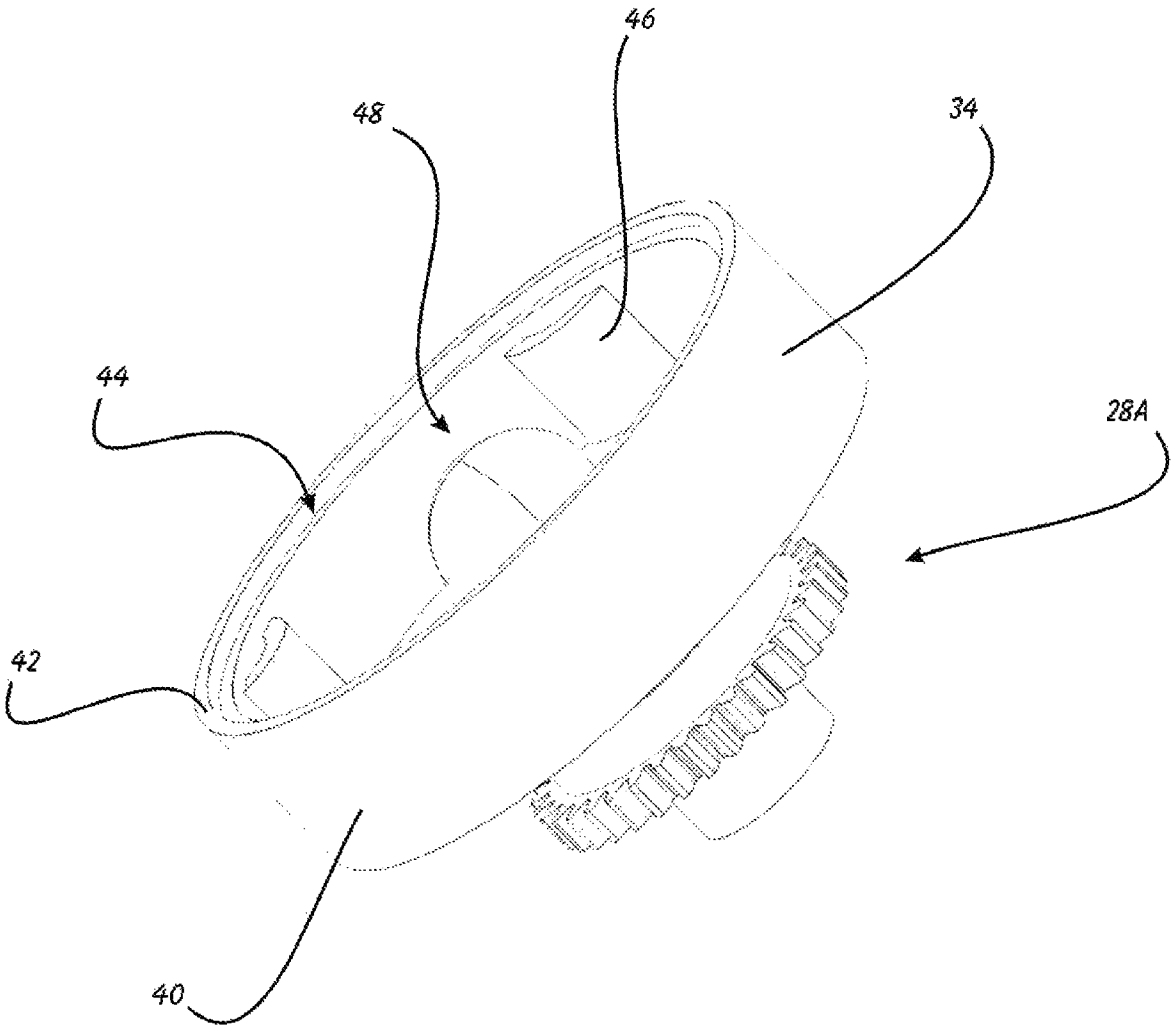
FIG. 3 is a partial perspective view of the floating head of FIG. 2.

The drive assembly (see FIG. 1) external to the housing [16][1] may be connected to the internal structure shown here where the drive assembly provides rotating or oscillating motion. The drive gear 36 receives mechanical drive force from the internal electric motor. The tail shaft 38 serves to restrain the drive assembly/gear 36 from moving, while also allowing it to rotate/oscillate. For the sake of simplicity, it is also possible that the depicted structure is also used for the vibrating version of the device [10]. FIG. 3 provides additional detail regarding this design.

[1] As used throughout this disclosure, element numbers enclosed in square brackets [ ] indicates that the referenced element is not shown in the instant drawing figure, but rather is displayed elsewhere in another drawing figure.

FIG. 3 is a partial perspective view of the floating head 14A of FIG. 2. Here, the first version of the drive assembly 28A is depicted. Unlike the hexagonal head depicted in the assembly [28B] of FIG. 1, this version has a pivot head 48 that protrudes through an aperture formed in the bottom of the support cup 34. The pivot head 48 is discussed in more detail hereinbelow.

The support cup 34 is defined by a generally cylindrical shape having a sidewall 40 that terminates at its distal edge in an outer rim 42 that is of a shape to cooperate with the shape of the substrate [30]. An inner rim 44 slightly recessed into the sidewall 40 to engage an extended portion of the substrate [30] so that the cup 34 stays oriented and coupled with the substrate [30], and further to prevent foreign matter from entering in internal volume of the cup 34.

Figure 4A:
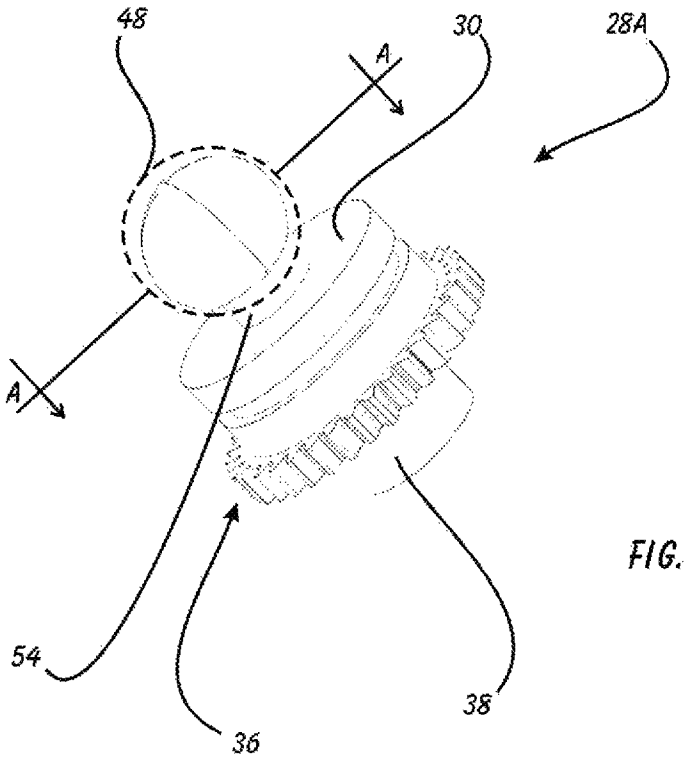
FIGS. 4A and 4B are partial perspective and cutaway top views, respectively, of the floating head of FIGS. 2 and 3.
Figure 4B:
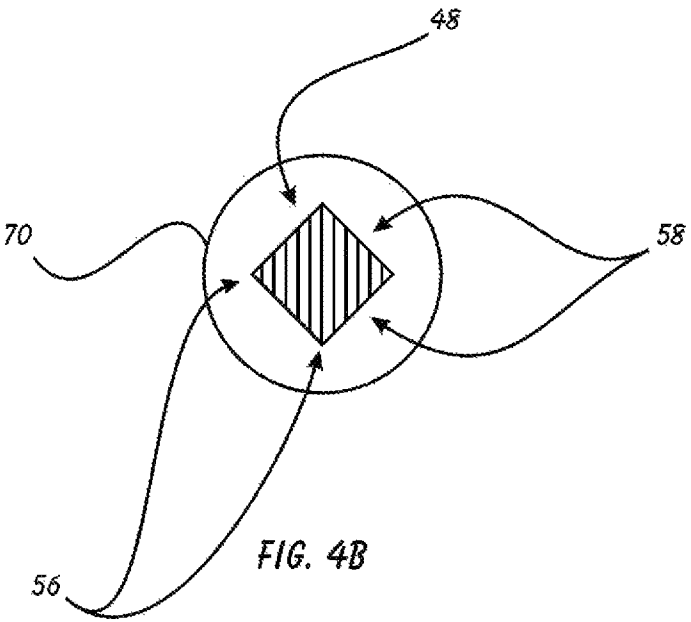

The sidewall 40 may have a plurality of rib elements 46 molded into the sidewall 40 so that the sidewall 40 resists crushing such that the cup 34 retains its shape for extended usage. FIGS. 4A and 4B explain the function and design of the pivot head 48.

FIGS. 4A and 4B are partial perspective and cutaway top views, respectively, of the floating head 14A of FIGS. 2 and 3. The first drive assembly 28A (whether rotatable or fixed) may be defined by a drive gear 36 and tail shaft 38. A base 70 protrudes from the face wall [26]. The neck 54 is of generally cylindrical configuration, and interconnects the base 70 and the pivot head 48.

The pivot head 48 has a generally globe-like shape, but with very distinct improvements thereto. In order to prevent any relative rotational motion between the pivot head 48 and the substrate [30], the pivot head 48 has a non-circular cross-section (see FIG. 4B). This non-circular cross-section is achieved by having a plurality of curved or arcuate side faces 58 separated from one another by an equivalent number of longitudinal ridges 56. While a 4-sided cross-section is depicted here, it should be understood that a variety of other configurations may be employed within the spirit of the invention.

Figure 5:
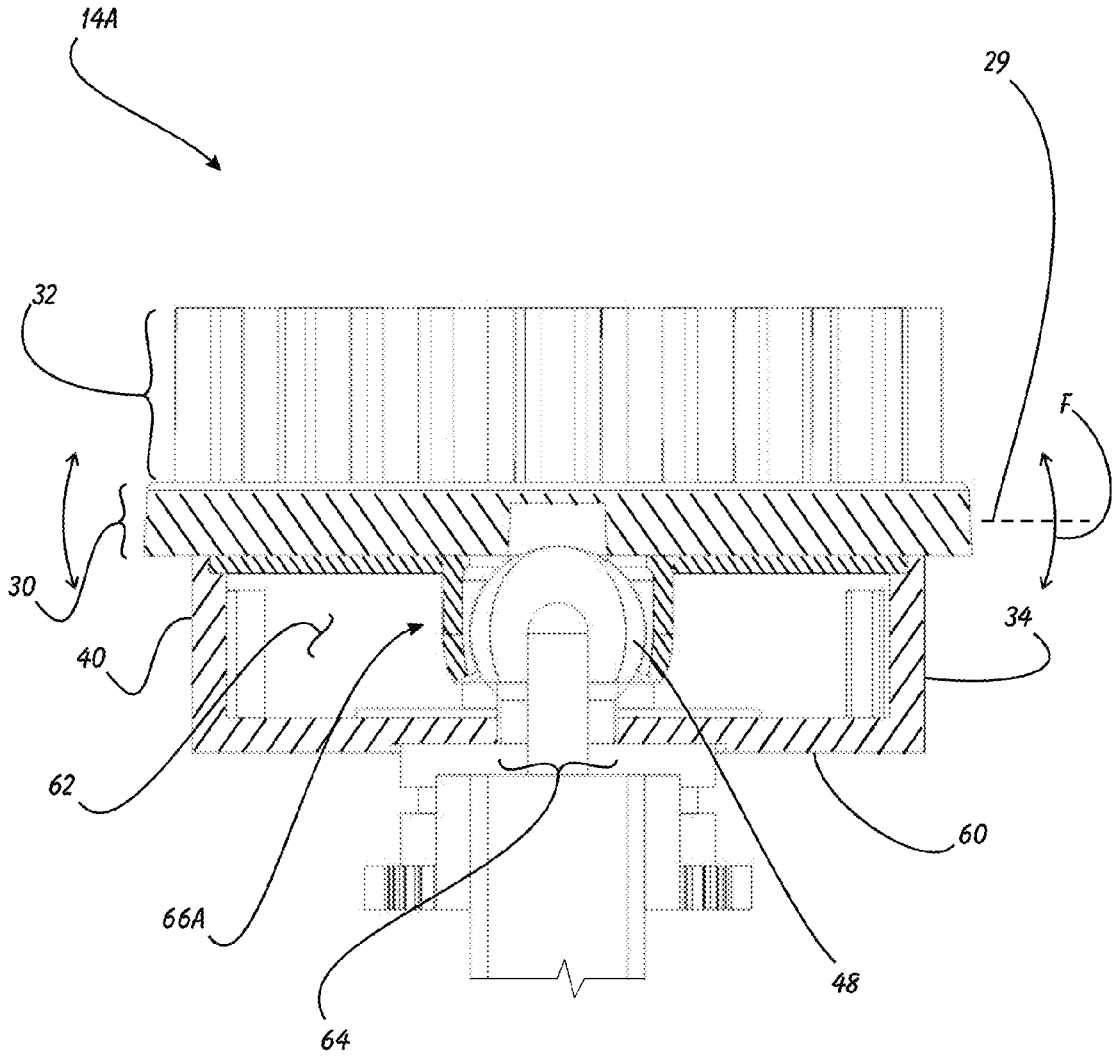
FIG. 5 is a cutaway side view of the floating head of FIGS. 2-4A/4B.

Finally, while the ridges 56 will prevent slippage between the substrate [30] and the pivot head 48, they will not prevent relative "rocking" motion between the substrate [30] and the first drive assembly 28A. FIG. 5 provides the detail necessary to understand this design.

FIG. 5 is a cutaway side view of the floating head 14A of FIGS. 2-4A/4B. The bottom wall 60 of the support cup 34 has an aperture 64 formed therethrough. The aperture 64 is centered on the bottom wall 60 and sized in order to permit the pivot head 48 to be pressed through it, and then to relax into position so that it closely fits to the neck [54] to prevent intrusion of foreign matter into the internal void 62 of the support cup 34.

A first receiver 66A extends downwardly (in this orientation) from the back-side of the substrate 30. The first receiver 66A is made from a series of fingers or prongs that will allow the pivot head 48 to snap into it (and out of it if appropriate pulling force is exerted onto it). The first receiver 66A may be described as a "snap socket," and is preferably molded as a integral part of the substrate 30.

As discussed previously, the receiver 66A, in cooperation with the surface topography of the pivot head 48, will allow for angular motion (in the direction of arrows "F"), but will prevent rotational slippage between these two elements so that the treatment head will either move with the drive assembly [28A] (e.g. rotating or oscillating), or will be prevented from movement (i.e. when the device is in vibration-only mode). Hence, any rotational torque will be transferred between the pivot head 48 and the receiver 66A. The result is that the second spatial plane 29 defined by the substrate 30 will be allowed to rock in the direction shown by arrows "F," which allows for the floating motion relative to the first spatial plane [27] defined in FIG. 1. The cup 34 may be made from silicone material, and is included in order to provide a certain amount of "centering" or "re-set" force against the substrate 30 to return the substrate 30 into the rest (i.e. non-deflected) position. We will now turn to FIGS. 6-9 to understand another embodiment of the floating head.

Figure 6:
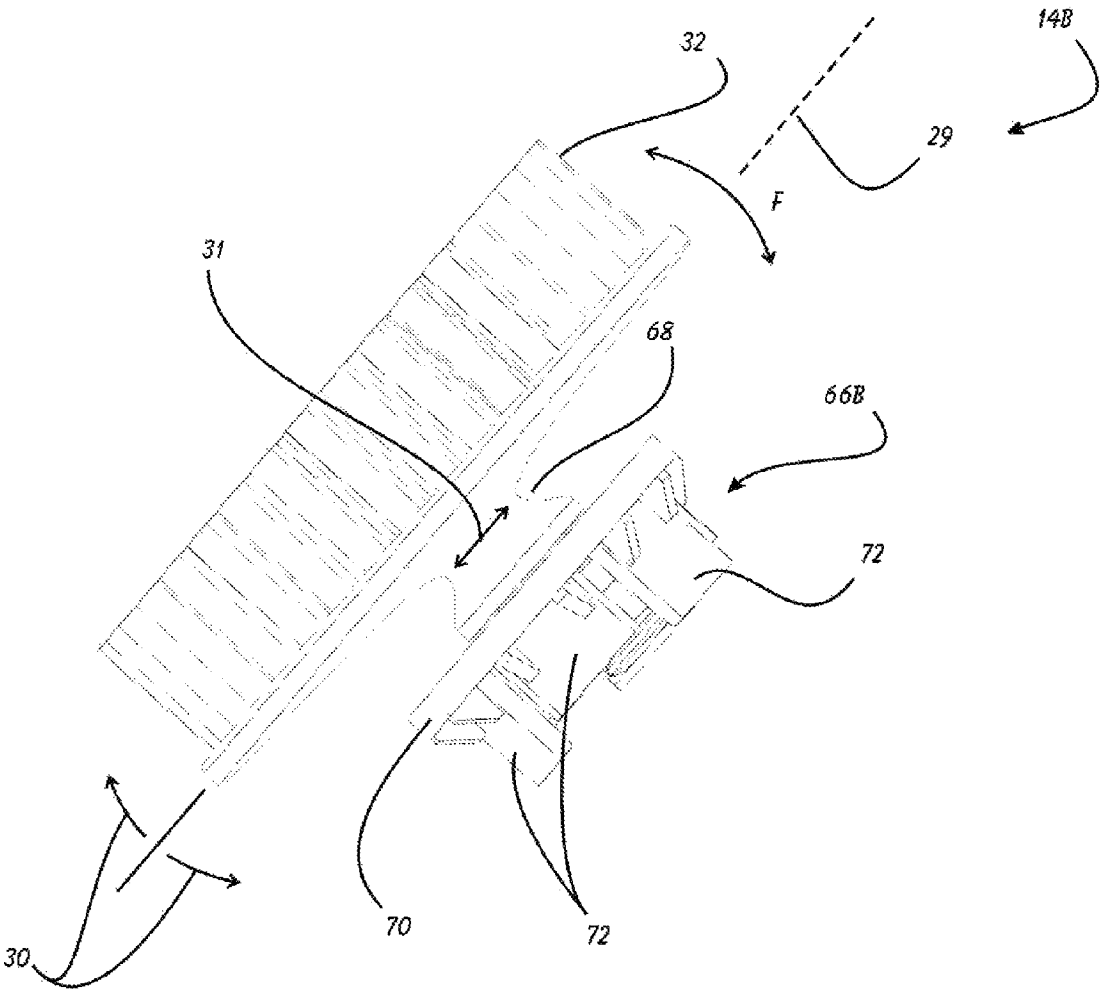
FIG. 6 is a side view of the second floating head of FIG. 1.

FIG. 6 is a side view of the second floating head 14B of FIG. 1. Essentially, the floating motion is provided by this design by virtue of the use of flexible material of construction for portions of the support structure for the substrate 30. Specifically, the head 14B has a waist element 68, which is bonded or molded to the substrate 30. The waist element 68 is made from silicone or other rubber-like material. The material flexibility, along with the thinned-down throat 31 portion, allows the substrate 30 to float as depicted by "F." In its preferred form, the outer diameter of the waist element 68 will be less than one-half the outer diameter of the substrate 30, so that sufficient flexibility is present.

Figure 7:
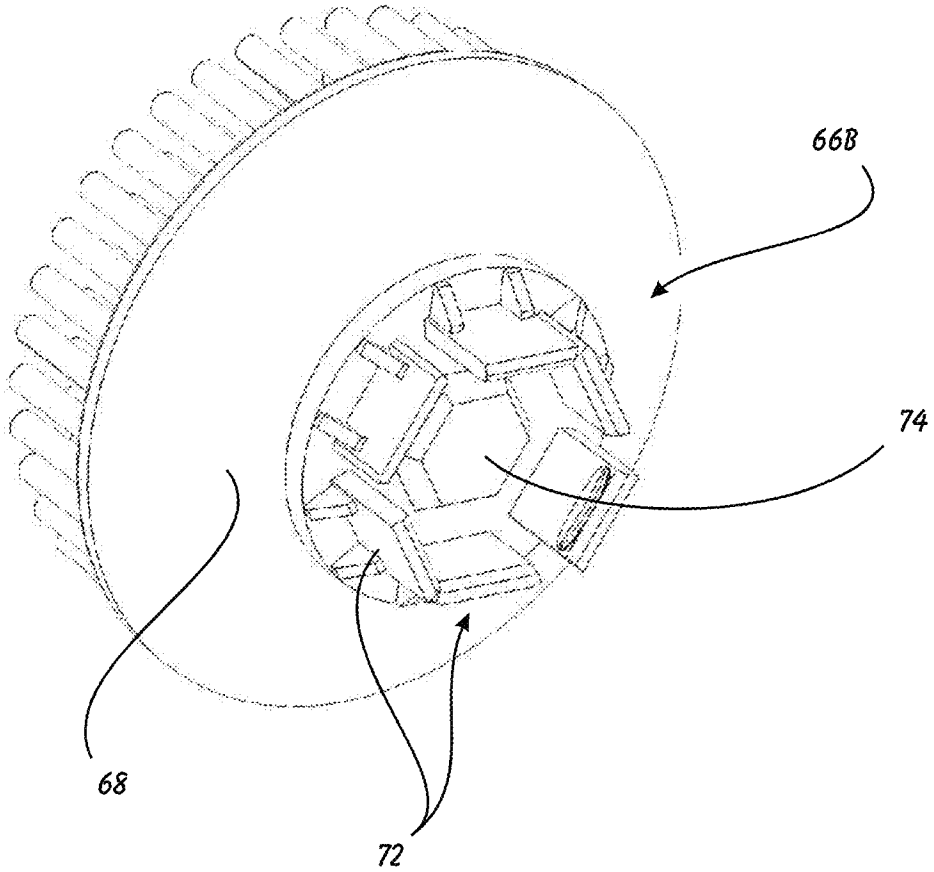
FIG. 7 is a rear perspective view of the floating head of FIG. 6.
Figure 8:
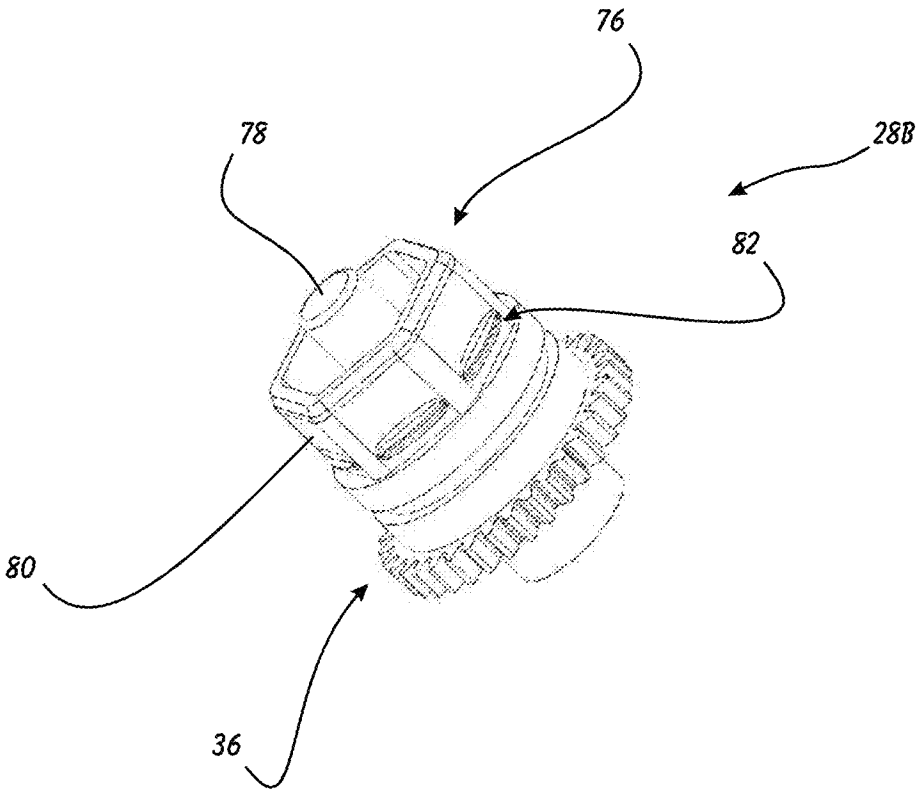
FIG. 8 is a perspective view of the second drive assembly of FIG. 1.

A second receiver 66B, made from non-rubberized, hard plastic-type material interconnects the waist element 68 with the drive assembly [28B]. The receiver 66B is defined by a base 70, from which extend a plurality of tabs 72, which serve to grasp the outer walls of the hexagonal drive assembly [28B]. As shown in FIG. 7, the waist element 68 terminates at its bottom end (i.e. distal to the substrate 30) in a tip 74. The waist element tip 74 is press-fit through an aperture formed in the base [70] of the receiver 66B. The pliability of the material comprising the waist element 68 allows the tip 74 to deform enough to be pushed through the aperture, after which the edges return to their rest state and grip the base [70] to prevent any relative motion (rotational) between the waist element 68 and the receiver base [70]. FIG. 8 is provided to support the explanation of the drive assembly 28B.

Figure 9:
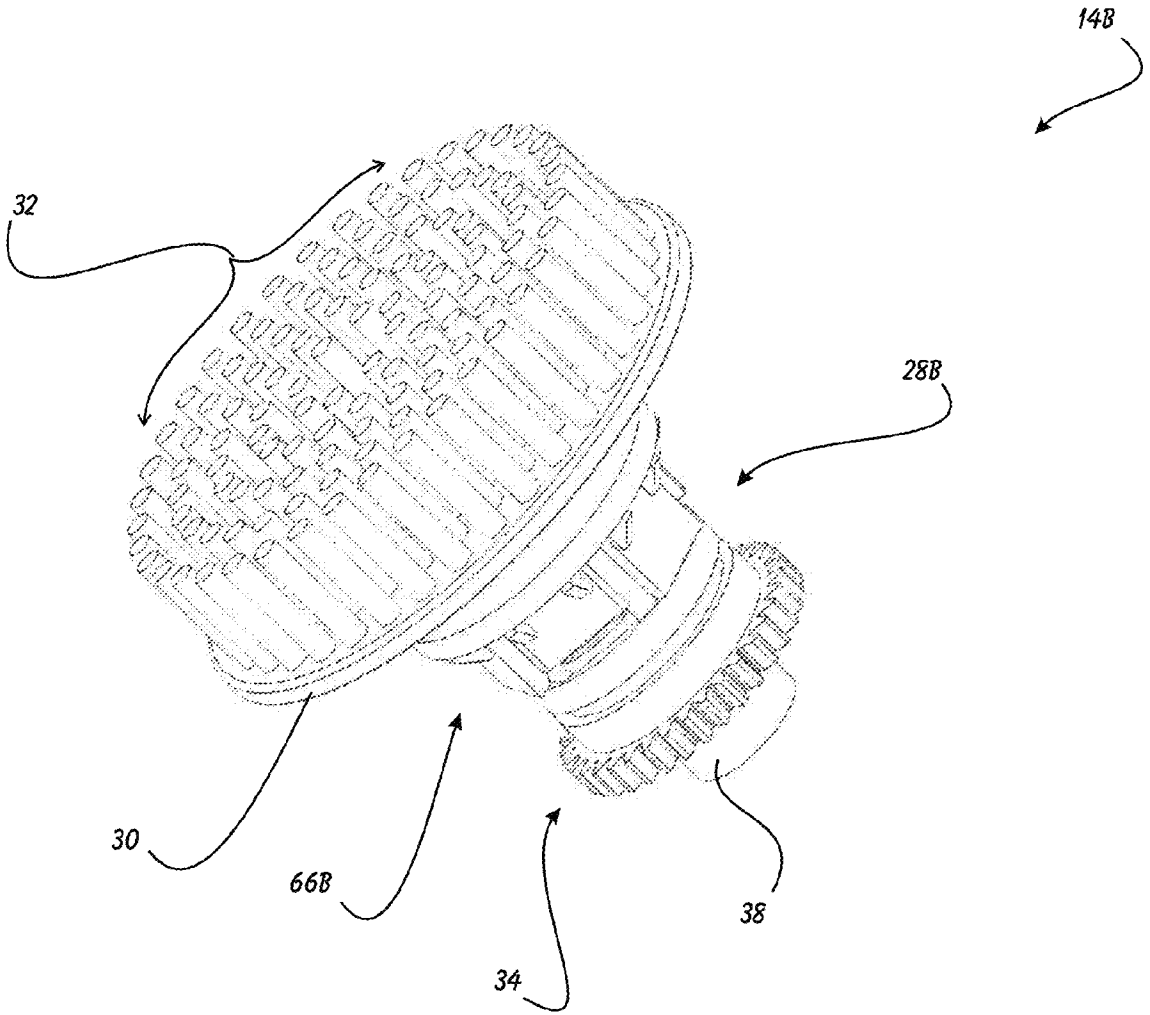
FIG. 9 is a perspective view of the floating head of FIGS. 6 and 7.

FIG. 8 is a perspective view of the second drive assembly 28B of FIG. 1. The drive assembly 28B may also have a drive gear 36 internal to the housing [16] (particularly if the assembly 28B is rotatable). A polygon-shaped drive spindle 76 protrudes from the housing [16] for the purpose of engaging the receiver 66B. The polygon shape (hexagon in this version) is defined by the six upright generally flat sides to the outer wall 80 of the spindle 76. In its preferred form, a plurality of grooves 82 are formed at the base of the wall 80. The grooves 82 engage corresponding teeth formed at the tips of the individual tabs [72] of the receiver [66B]. A center peg 78 protrudes slightly beyond the upper rim of the outer wall 80. The peg 78 is provided to create stiffness in the drive spindle 76 without adding extensive amounts of material or weight to the spindle 76. When the floating head 14B is attached to the handpiece [12], it does so as depicted in FIG. 9 (without depicting the housing [16] itself). The polygon shape depicted here is merely exemplary, and has found to be very suitable for the instant purpose. However, other shapes are expected and therefore are intended to be incorporated within this disclosure. Yet another version of the floating head is depicted by FIGS. 10-14.

Figure 10:
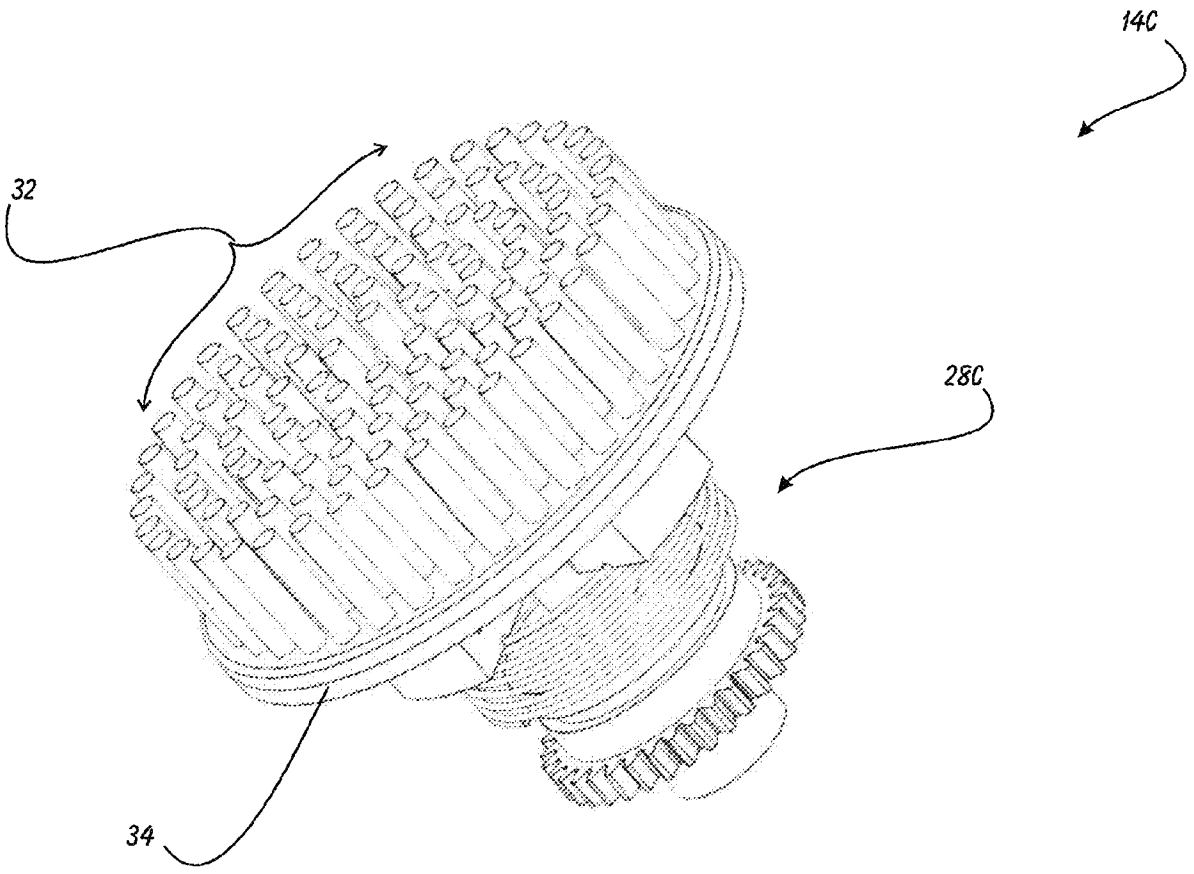
FIG. 10 is a perspective view of the third floating head of FIG. 1.

FIG. 10 is a perspective view of the third floating head 14C of FIG. 1. This design may be characterized as a "spring-loaded joystick" mechanism. Before discussing the floating head 14C, we will study the details of the third drive assembly 28C.

Figure 11:
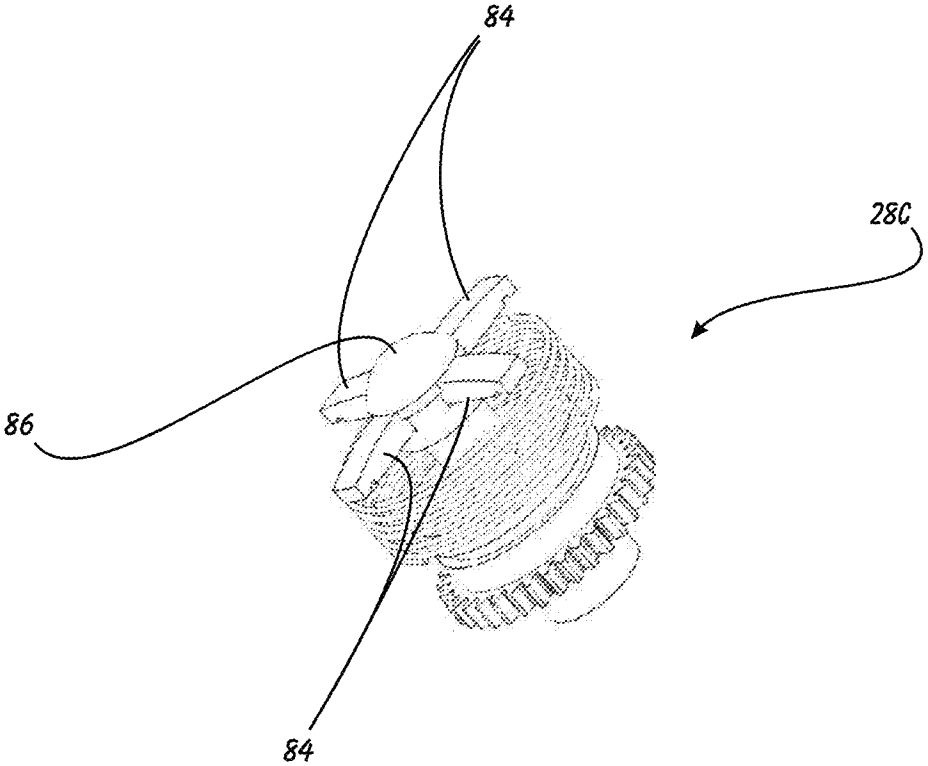
FIG. 11 is a perspective view of a third preferred embodiment of the drive assembly of the present invention.

FIG. 11 is a perspective view of a third preferred embodiment of the drive assembly 28C of the present invention. The base [70] has an internal drive shaft [98] extending upwardly from it to terminate in a cap element 86 at its distal end. The cap element 86 serves to secure a plurality of drive fingers 84 onto the internal drive shaft [98]. As will be clear from FIG. 12, the drive fingers 84 provide the interconnection between the drive assembly 28C and the substrate [30] in order to retain the substrate [30] thereto, to transfer torque therebetween, but also to allow for the floating relative motion therebetween.

Figure 12:
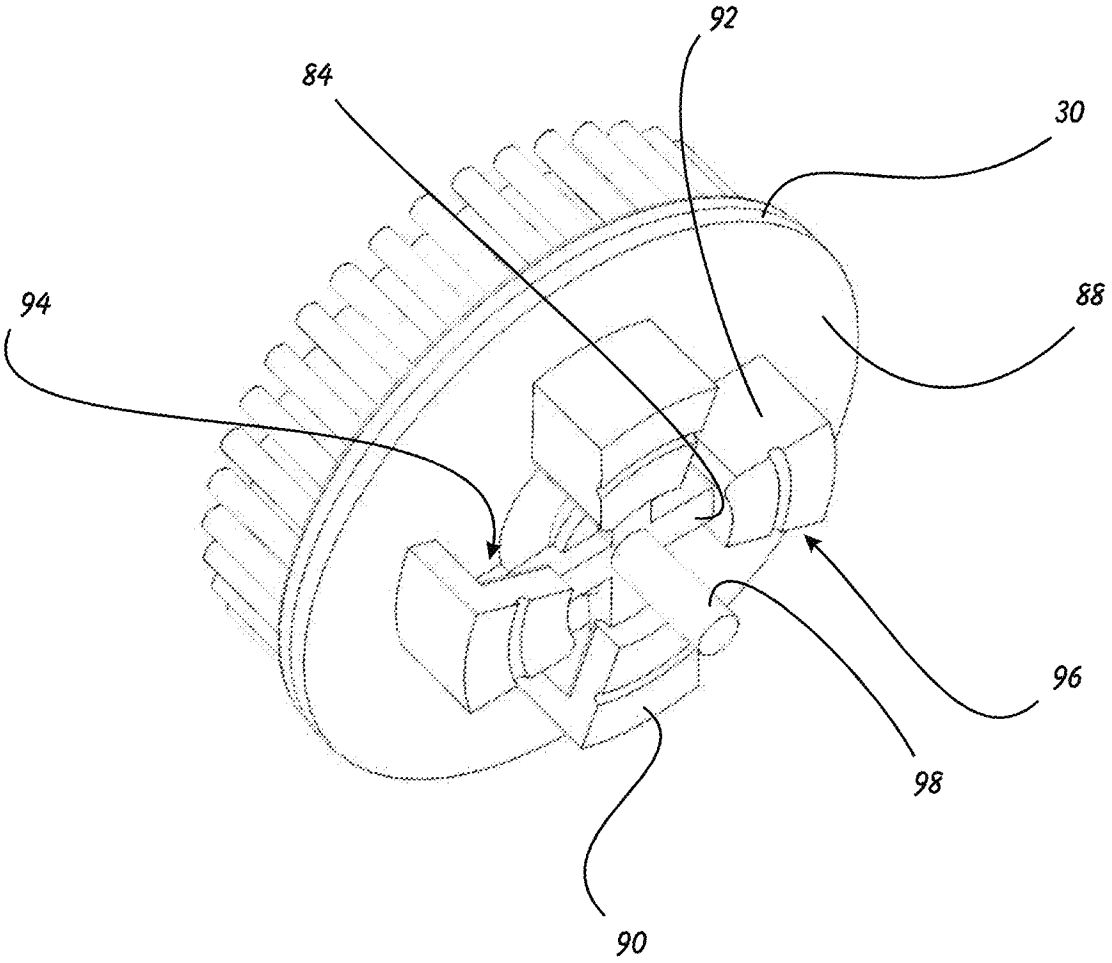
FIG. 12 is a partial rear perspective view of the floating head of FIG. 10.

FIG. 12 is a partial rear perspective view of the floating head 14C of FIG. 10. In this partial view, the drive fingers 84 have engaged the substrate by operation of the four drive brackets 90 extending downwardly therefrom. The drive brackets 90 extend from the bottom face 88 of the substrate 30, and are preferably molded as integral portions thereof. These particular drive brackets 90 are formed with an open side (see generally the arrowhead of finger pocket 94). The open sides permit the fingers 84 to be twist-engaged and—disengaged from the brackets 90. When engaged, the tips of the fingers 84 reside within the finger pockets 94 formed within the brackets 90.

The inner drive shaft 98 extends from the fingers 84 to be captured by the outer drive shaft [100]. A centering groove 96 is preferably cut into the bottom faces of each of the drive brackets 90. If we turn to FIG. 13, we can see that these centering grooves 96 retain the upper ring of the biasing element 92 so that the biasing element 92 remains firmly compressed between the drive brackets 90 and the base [70]. FIG. 14 is provided to clarify this somewhat complex arrangement of elements.

Figure 13:
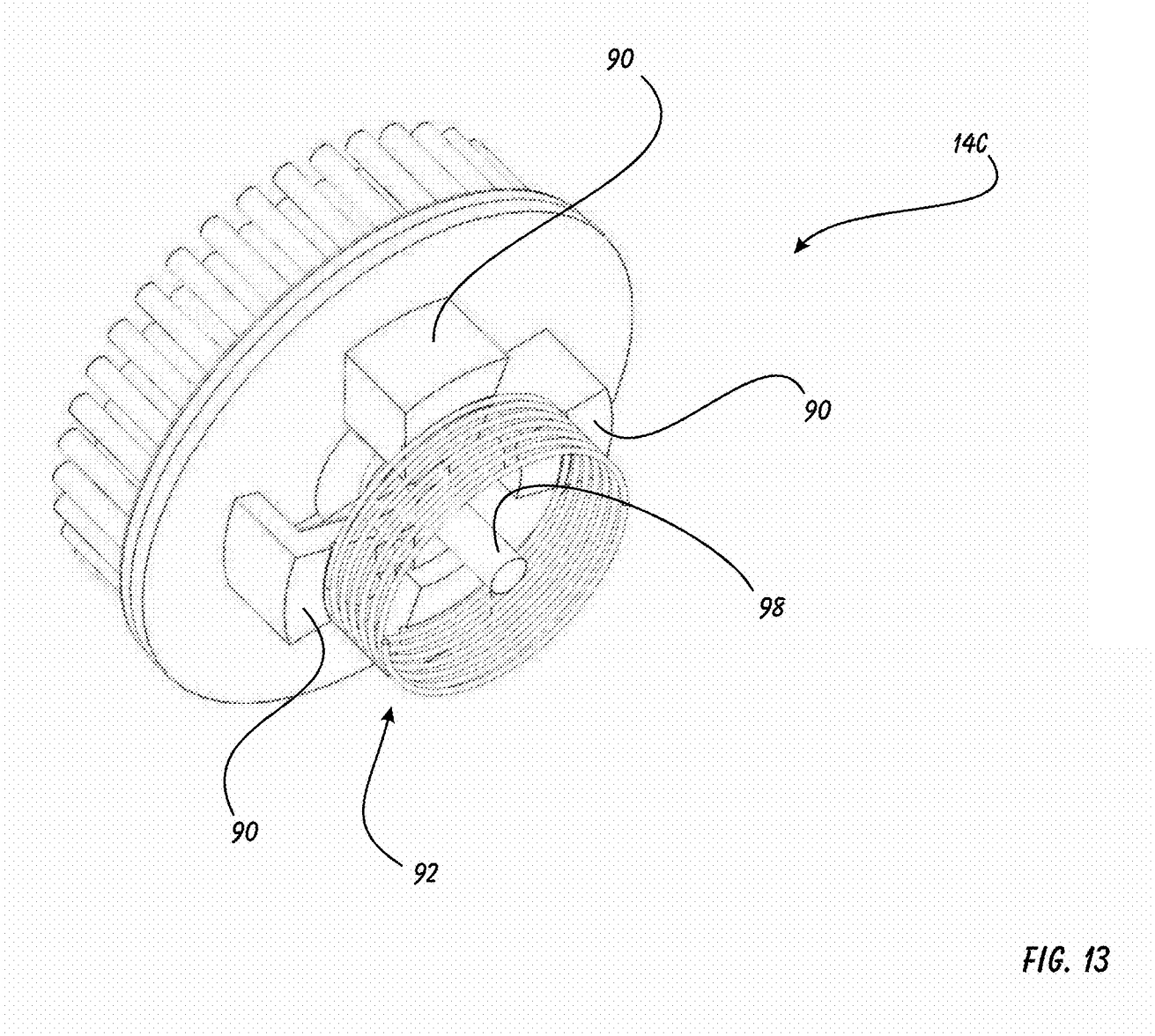
FIG. 13 is another partial rear perspective view of the floating head of FIGS. 10 and 12.
Figure 14:
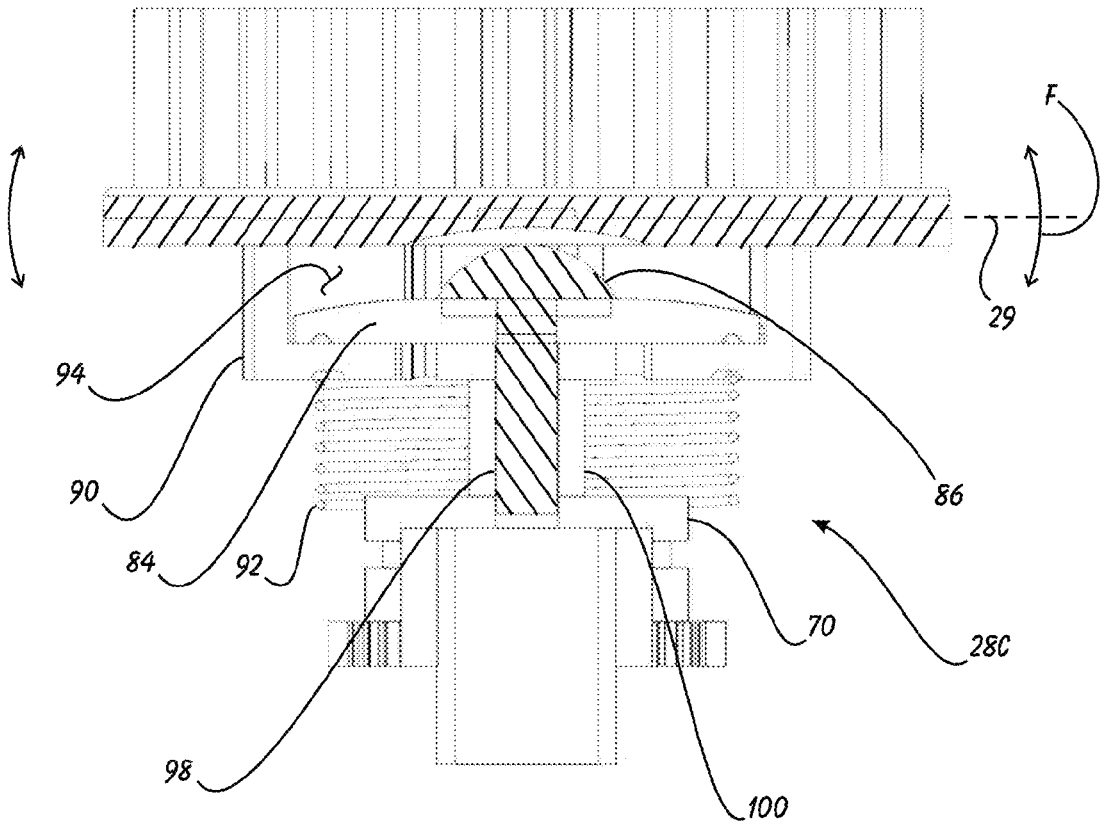
FIG. 14 is a cutaway side view of the floating head of FIGS. 10, 12 and 13.

FIG. 14 is a cutaway side view of the floating head 14C of FIGS. 10, 12 and 13. The inner drive shaft 98 extends between the cap element 86 and the base 70, and is inserted into a bore formed in the outer drive shaft 100. The outer drive shaft 100 is an integral part of the drive gear [36] and tail shaft [38]; the inner drive shaft 98 is glued or otherwise bonded into the inner bore of the outer drive shaft 100 during assembly.

Once the drive fingers 84 have engaged the drive brackets 90, the biasing element 92 is captured between the base 70 and the drive brackets 90 (and creating biasing force upward against the drive brackets 90). The internal void within the finger pockets 94 will allow the drive fingers 84 to move (upwardly in this view), which permits the substrate 30 to float (i.e. the plane 29 will move in direction "F"). The pushing force of the captured biasing element 92 will tend to urge the substrate 30 back towards its normal, rest position (as depicted here).

Figure 15:
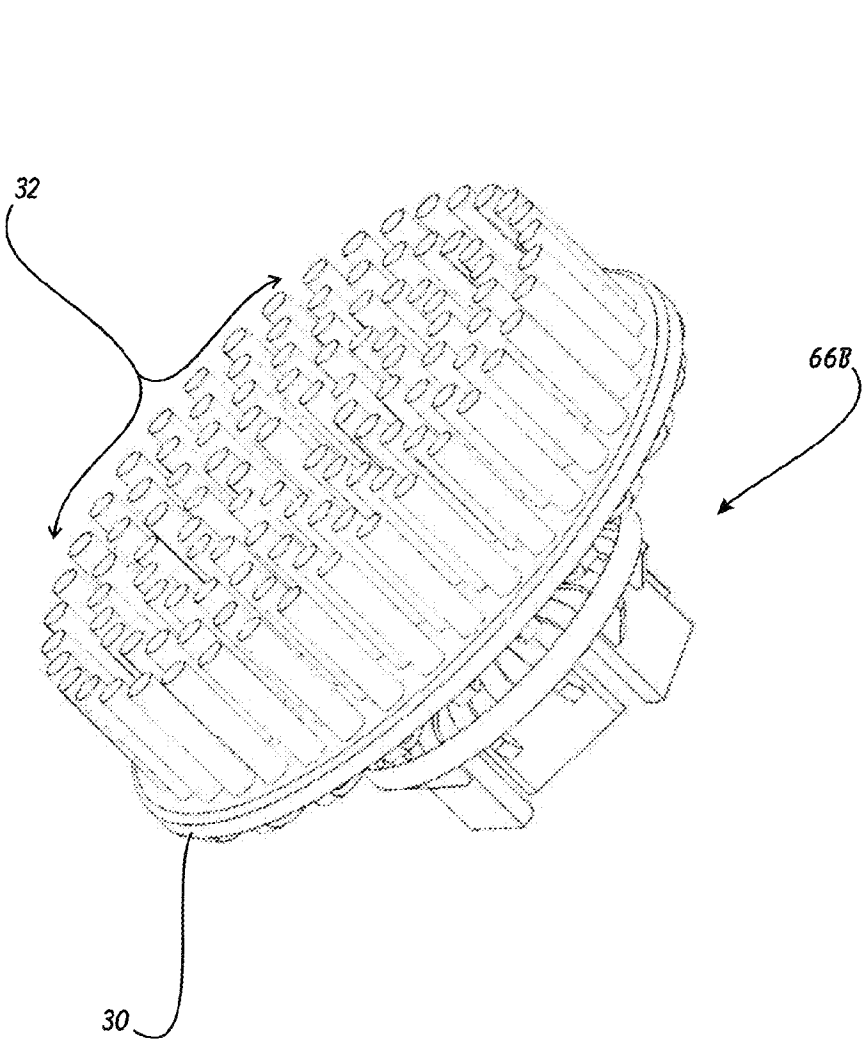
FIG. 15 is a perspective view of the fourth floating head of FIG. 1.
Figure 16:
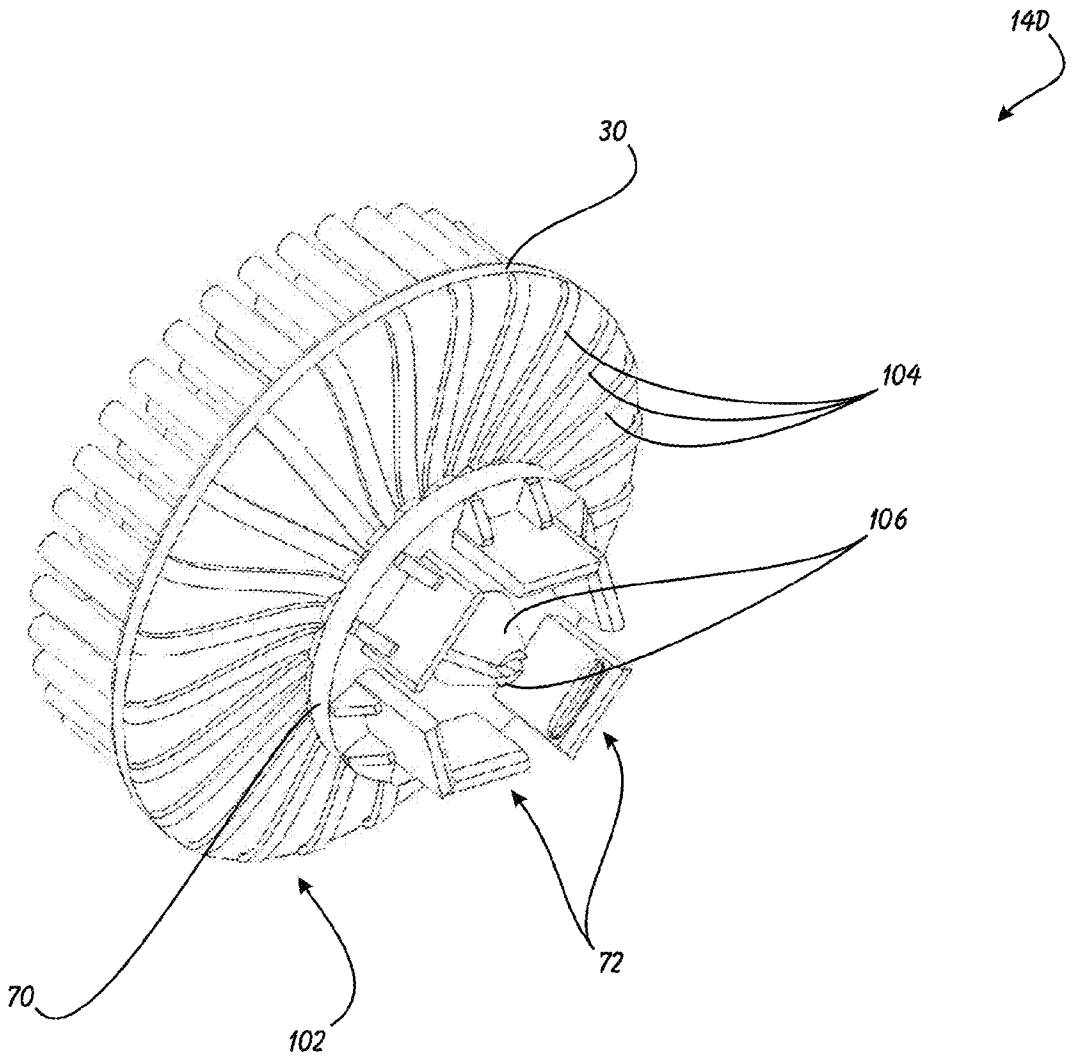
FIG. 16 is a rear perspective view of the floating head of FIG. 15.

FIG. 15 is a perspective view of the fourth floating head 14D of FIG. 1. This design 14D provides functionality essentially equivalent to those discussed above, but through very simple design. The head 14D utilizes a very unique "cage" constructed of several individual spring strands interconnecting the substrate and the receiver to create the flexing necessary for the floating characteristic previously described. FIG. 16 provides the detail of this fourth design.

Figure 17:
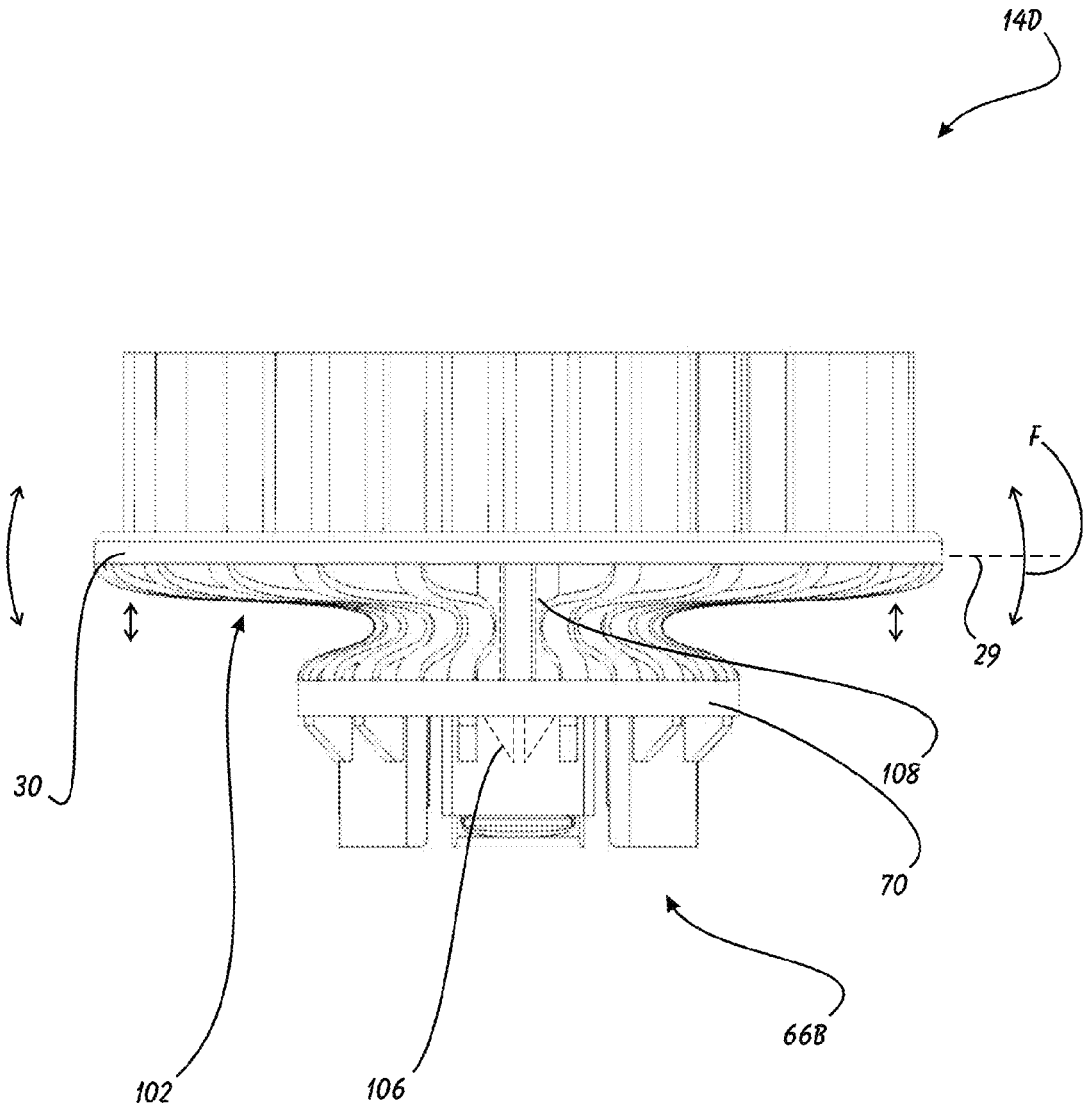
FIG. 17 is a side view of the floating head of FIGS. 15 and 16.

FIG. 16 is a rear perspective view of the floating head 14D of FIG. 15. Sandwiched in between the base 70 and the substrate 30 is a spring cage 102 that is comprised of a circular set of individual spring strands 104 that encircle the entire 360 degrees of the substrate 30 and base 70. The strands 104 comprising the cage 102 will likely have rings interconnecting the individual strands 104 at the contact point with the substrate 30 and the base 70. A retention shaft tip 106 (which is preferably split in order to allow it to be compressed) protrudes through an aperture formed in the center of the base 70 when the head 14D is assembled. FIG. 17 provides additional detail regarding the operation thereof.

FIG. 17 is a side view of the floating head 14D of FIGS. 15 and 16. The second spatial plane 29 defined by the substrate 30 is permitted to flex in direction "F" because the individual spring strands 104 will flex as pressure is exerted atop the bristles/sponge, etc. The spring cage 102 is compressed between the substrate 30 and base 70 such that it is pre-loaded to generate a stabilizing force pushing these two elements apart. This preloading is accomplishing by pressing the substrate 30 towards the base 70 during assembly so that the springs [104] of the cage 102 are compressed until the retention shaft tip 106 protrudes through an aperture formed in the center of the base 70. As can be seen here, the retention shaft tip 106 is at the distal end of the retention shaft 108, which extends from the bottom side of the substrate 30 (and is very likely a contiguous element of the substrate 30). If it disassembly is necessary, the two halves of the retention shaft tip 106 need simply to pinched together so that the "barb" formed at its end will fit through the aperture formed in the base 70. As depicted below in FIGS. 18A, 18B and 19, several permutations of the various design discussed above are included herein. These figures depict a second version of the first floating head.

Figure 18A:
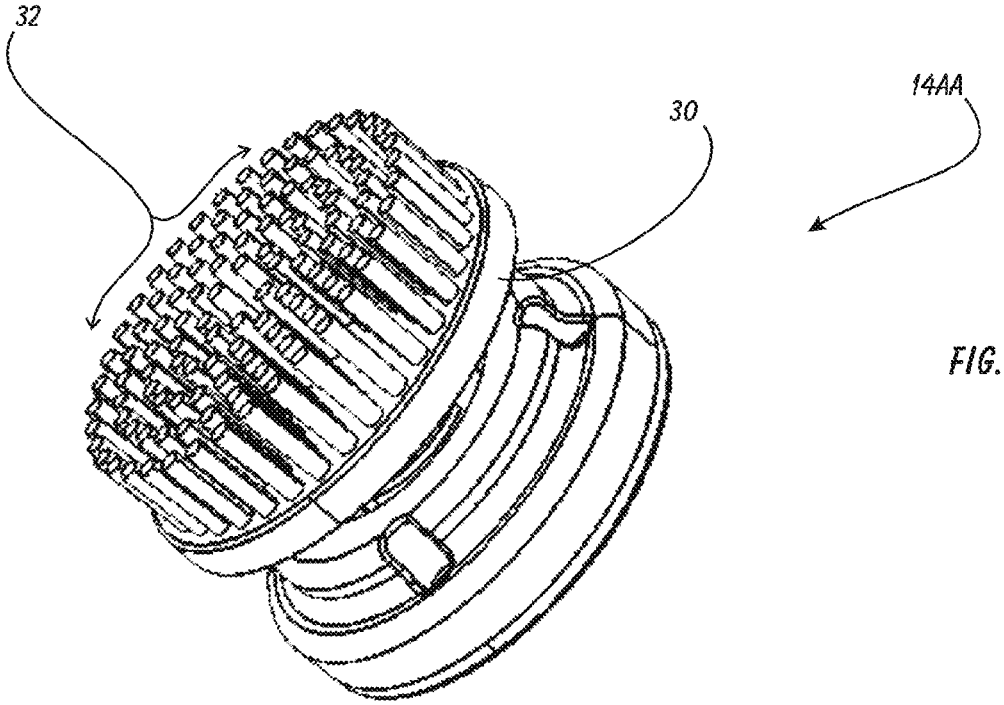
FIGS. 18A and 18B are front and rear perspective views, respectively, of a second version of the first floating head design.
Figure 18B:
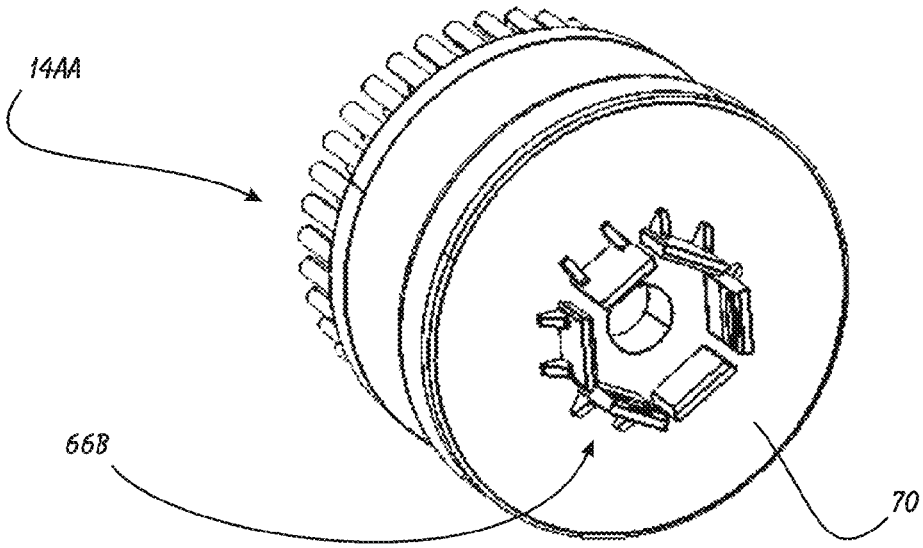

FIGS. 18A and 18B are front and rear perspective views, respectively, of the second version of the first floating head design 14AA. This version has a slightly different arrangement of parts as compared to the first floating head design 14A, but is particularly suitable for the instant application because it is completely interchangeable with a conventional (non-floating/pivoting) treatment head. The brush elements 32 (or other treatment surfaces, such as abrasive material, massage pebbled surface, sponge and other interchangeable treatment faces as described in the parent disclosures). The handpiece-facing side of the head 14AA terminates in base 70. The base 70 preferably has a second receiver 66B extending from it for engagement with a drive assembly [28B] extending from the face of the handpiece. Further detail regarding this design and its ability to permit the treatment face to float is easily understood by review of FIG. 19.

Figure 19:
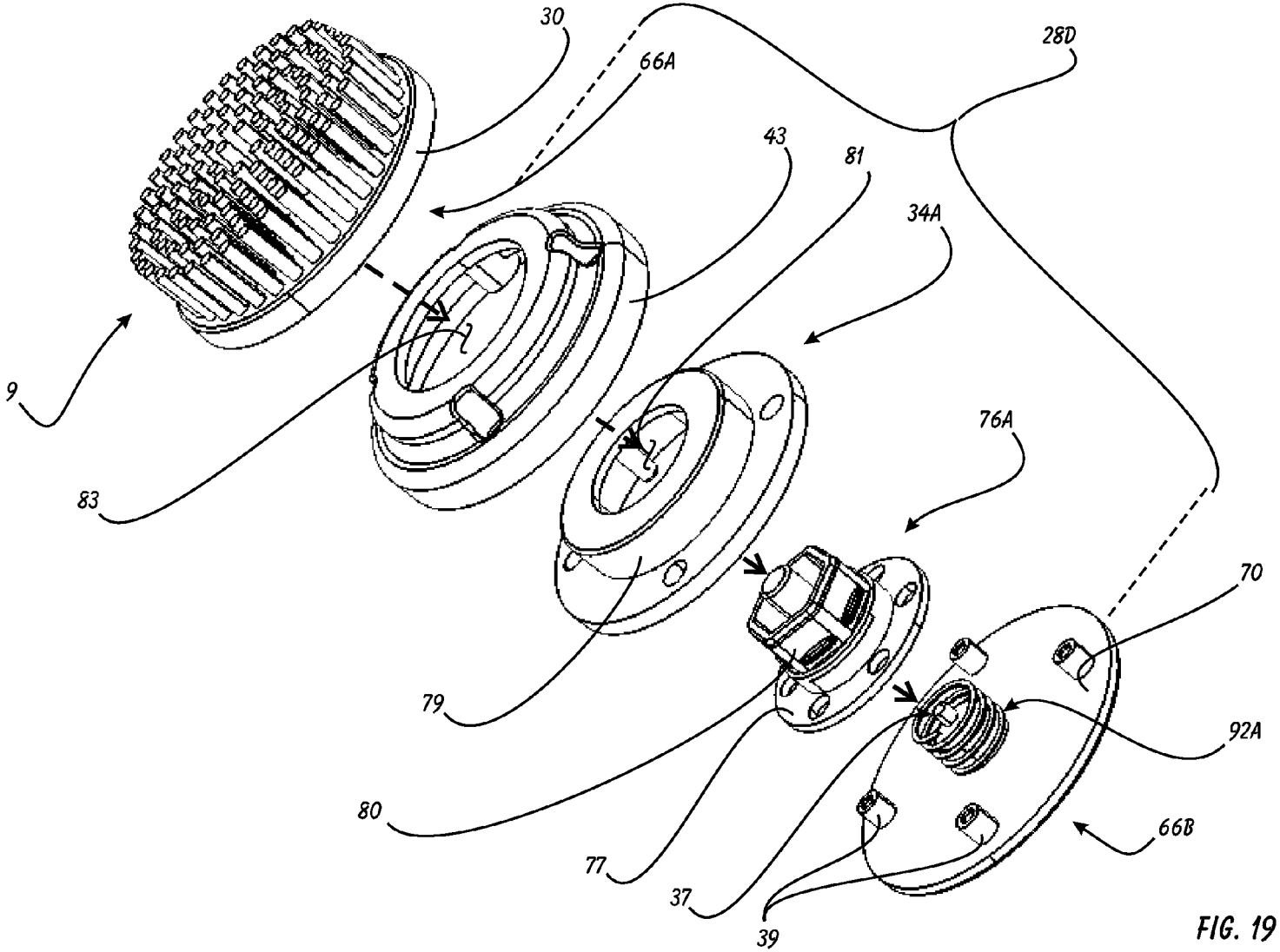
FIG. 19 is an exploded perspective view of the floating head of FIGS. 18A and 18B.

FIG. 19 is an exploded perspective view of the floating head 14AA of FIGS. 18A and 18B. The base 70 has a plurality of mounting stems 39 extending upwardly from it that each preferably have threaded bores formed within them. A screw (not shown) engages each threaded bore to keep the components of the head assembly 14AA together.

Centered on the base 70, a base peg 37 extends upwardly in order to provide support for the biasing element 92A and the floating drive spindle 76A. Collectively, the base 70, base peg 37, biasing element 92A and floating drive spindle 76A are the fourth drive assembly 28D. The spindle 76A rests atop the base peg 37 and biasing element 92A and is retained there by the support cup 34A.

The support cup 34A is preferably made from a pliable material, such as silicone or other suitable material. There is a base ring surrounding an upstanding shoulder rim 79. The shoulder rim 79 has a spindle aperture 81 formed and sized so that the floating drive spindle 76A can protrude therethrough, but the aperture 81 is smaller than the diameter of the spindle base 77, so that the spindle base 77 is captured under the shoulder rim 79.

The biasing element 92A urges the floating drive spindle 76A upward against the shoulder rim 79, while still permitting movement downward (towards the base 70) so that the drive spindle 76A will be permitted to float so that the facial brush 9 will follow the contour of the user's body. The pliability of the support cup 34A further increases the potential tiltability of the drive spindle 76A because the shoulder rim 79 will flex and allow additional movement of the spindle base 77. The perimeter apertures around the base ring of the support cup 34A are configured to readily line up with the mounting stems 39 extending from the base 70 so that the assembly screws (not shown) can pass through them.

The support cup 34A is captured between the base 70 and top cap 43. The top cap 43 has a shoulder aperture 83 formed in its top side that is sized in order to permit the shoulder rim 79 (and drive spindle 76A) to protrude through it. A set of perimeter apertures are formed through the top cap 43 to align with the mounting stems 39 so that assembly screws (not shown) will pass through the top cap perimeter apertures, through the support cup perimeter apertures, and then threadedly engage the threaded bores formed in the mounting stems 39 in order to form a clean, aesthetically pleasing assembly. A second receiver 66B extends from the brush substrate 30, such that it can engage the floating drive spindle 76A that is protruding through the spindle aperture 81 and the shoulder aperture 83.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A facial brush assembly, comprising:

a handpiece, comprising a housing, said housing defining a handle portion and a head portion, said head portion having a generally planar face wall, said face wall defining a first spatial plane, and having a first spindle protruding therefrom;

a skin engagement assembly comprising a substrate receiver disposed on a substrate; and a floating assembly located between said first spindle and said substrate, wherein said first spindle defines a first spatial plane and said substrate defines a second spatial plane, and wherein said floating assembly comprises a flexible interconnection between said substrate and said first spindle that enables said floating assembly to deform from a rest state where said first and second spatial planes are relatively parallel and into a deflected state where said first and second spatial planes are relatively non-parallel, and wherein said first spindle is defined by an outer wall having a plurality of interconnected, generally flat panels, said floating assembly further comprising a receiver base from which a second receiver extends on one side, and from which a second spindle extends on an opposing side, with said second spindle engaging said substrate receiver and said second receiver engaging said first spindle; and said substrate receiver cooperates with said first spindle and said second spindle such that either said spindle is receivable within said substrate receiver.

2. The assembly of claim 1, wherein said substrate receiver defines a first spatial plane and said second spindle defining a second spatial plane, and wherein said floating assembly comprises a flexible interconnection between said substrate receiver and said second spindle that enables said floating assembly to deform from a rest state where said first and second spatial planes are relatively parallel and into a deflected state where said first and second spatial planes are relatively non-parallel.

3. The assembly of claim 2 further comprising a support cup disposed between said second spindle and said top cap, said support cup being constructed from pliable material and further defined by a spindle aperture for aligning with said top cap aperture to accept said second spindle therethrough.

4. The assembly of claim 1, further comprising a top cap attachable to said receiver base, said top cap further defined by an aperture formed therethrough, and said second spindle protruding through said top cap aperture.

5. The assembly of claim 4, wherein said receiver base further comprises a base peg extending from a side opposite to said receiver and located to be received within said second spindle; and said assembly further comprising a biasing element around said base peg for urging said second spindle towards said support cup and said top cap.

6. A facial brush assembly, comprising:

a handpiece, comprising a housing, said housing defining a handle portion and a head portion, said head portion having a generally planar face wall and a first spindle defined by an outer wall having a plurality of interconnected, panels extending therefrom, said face wall defining a first spatial plane;

an electric motor and source of electrical power therefor contained within said housing;

a drive assembly comprising a first spindle protruding from said face wall; and a skin engagement assembly extending from said drive assembly, said assembly comprising:

a substrate element defined by a first side, an opposing second side, and at least one substrate spatial plane;

a substrate receiver element extending from said second side configured to engage either said first spindle or a second spindle;

one or more skin engaging elements protruding from said first side; and a floating subassembly interconnecting said substrate receiver element and said first spindle, said floating subassembly permitting relative motion between said substrate spatial plane and said face wall spatial plane and comprising said second spindle extending therefrom.

7. The assembly of claim 6, said floating subassembly further comprising a receiver base from which a second receiver extends on one side, and from which said second spindle extends on an opposing side, with said second spindle engaging said substrate receiver and said second receiver engaging said first spindle.

8. The assembly of claim 7, wherein said first receiver defines a first spatial plane and said second spindle defining a second spatial plane, and wherein said floating assembly comprises a flexible interconnection between said first receiver and said second spindle that enables said floating assembly to deform from a rest state where said first and second spatial planes are relatively parallel and into a deflected state where said first and second spatial planes are relatively non-parallel.

9. The assembly of claim 8, further comprising a top cap attachable to said receiver base, said top cap further defined by an aperture formed therethrough, and said second spindle protruding through said top cap aperture.

10. The assembly of claim 9 further comprising a support cup disposed between said second spindle and said top cap, said support cup being constructed from pliable material and further defined by a spindle aperture for aligning with said top cap aperture to accept said second spindle therethrough.

* * * * *